United States Patent [19]

Ahmed

[11] 4,058,760

[45] Nov. 15, 1977

[54] REFERENCE POTENTIAL GENERATORS

[75] Inventor: Adel Abdel Aziz Ahmed, Annandale, N.J.

[73] Assignee: RCA Corporation, New York, N.Y.

[21] Appl. No.: 714,359

[22] Filed: Aug. 16, 1976

[51] Int. Cl.[2] ..... G05F 1/58

[52] U.S. Cl. ..... 323/19; 323/22 T; 330/250

[58] Field of Search ..... 323/1, 4, 9, 19, 22 T, 323/23, 68; 330/32, 30 D; 307/297

[56] References Cited

U.S. PATENT DOCUMENTS

| | | | |
|---|---|---|---|
| 3,794,861 | 2/1974 | Bernacchi | 323/19 |
| 3,851,241 | 11/1974 | Wheatley, Jr. | 323/19 |
| 3,908,162 | 9/1975 | Marley et al. | 323/1 |
| 3,922,596 | 11/1975 | Cave et al. | 323/4 |
| T953,012 | 12/1976 | Radovsky | 323/4 |

*Primary Examiner*—Gerald Goldberg

*Attorney, Agent, or Firm*—H. Christoffersen; S. Cohen; A. L. Limberg

[57] ABSTRACT

A positive-temperature-coefficient potential is developed by scaling up from the potential difference appearing between the base electrodes of two transistors with interconnected emitter electrodes constrained by a positive feedback loop to operate with different densities of current flow through their respective base-emitter junctions. This positive-temperature-coefficient potential is added to a negative-temperature-coefficient potential derived from the base-emitter offset potential of one of the transistors, to provide the reference potential.

9 Claims, 4 Drawing Figures

REFERENCE POTENTIAL GENERATORS

Figure 1:
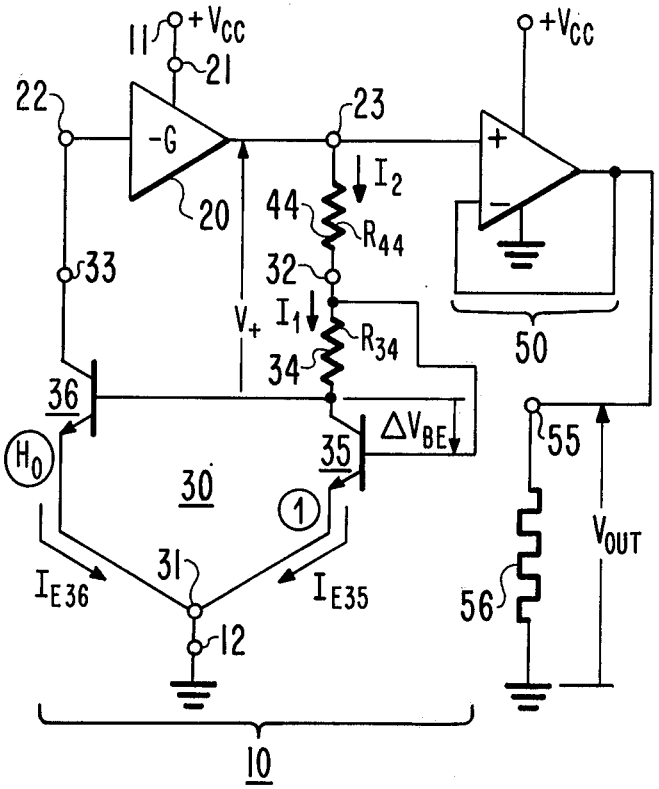

The present invention relates to reference potential generators.

Generators providing reference potentials composed of a negative-temperature-coefficient component proportional to the offset potential across a semiconductor junction and of a positive-temperature-component proportional to the difference between the offset potentials of a pair of semiconductor junctions operated at different current densities are known. They are favored for obtaining zero-temperature-coefficient reference potentials in monolithic integrated circuitry. See U.S. Pat. Nos. 3,271,660; 3,648,153; 3,887,863 and 3,893,018. An important difference between reference potential generators embodying the present invention and those of the prior art is the manner in which the positive-temperature-coefficient component of the reference potential is obtained. This and other significant features of the present invention will be dealt with in detail below.

Figure 3:
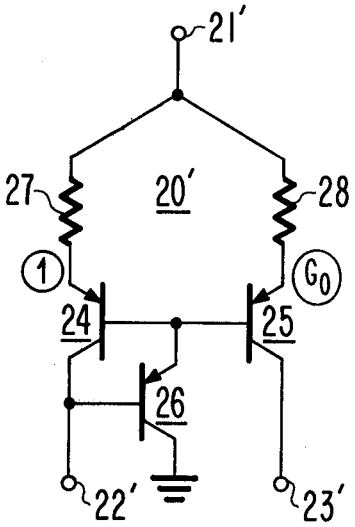
Figure 2:
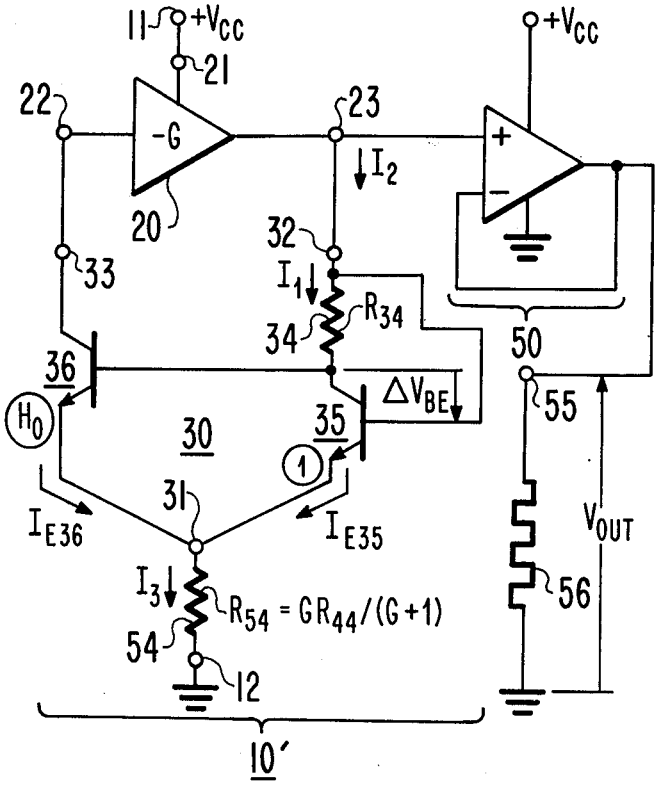
Figure 4:
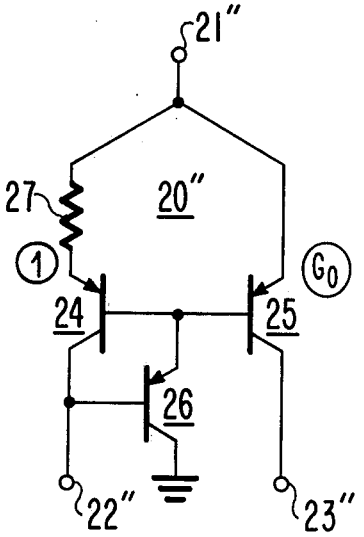

In the drawing:

FIGS. 1 and 2 are schematic diagrams of different reference potential generators, each embodying the present invention; and FIGS. 3 and 4 show alternative current amplifiers 20′ and 20″ to be used in implementing either of these reference potential generators.

In FIG. 1, current regulating circuitry 10 has a first terminal 11 and a second terminal 12 between which an operating potential $V_{CC}$ is applied. Current regulating circuitry 10 comprises a regenerative feedback loop connection of current amplifier 20 and of current amplifier 30, which latter current amplifier is of the type described by Harford and by Frederikson in U.S. Pat. Nos. 3,579,133 and 3,659,133. The common terminals 21 and 31 of current amplifiers 20 and 30, respectively, are connected respectively to terminal 11 and to terminal 12 of the current regulating circuit 10. The regenerative feedback loop is formed by (a) the output terminal 23 of current amplifier 20 being galvanically coupled via resistive element 44 to the input terminal 32 of current amplifier 30 and (b) the output terminal 33 of current amplifier 30 being galvanically coupled by direct connection to the input terminal 22 of current amplifier 20.

Current amplifier 30 includes, in addition to a resistive element 34, a first transistor 35 and a second transistor 36 so connected that they function as a current mirror amplifier at low current levels where the potential drop across resistive element 34 is less than a millivolt or so. At these low current levels, the current gain of current amplifier 30 is $-H_O$, $H_O$ being a positive number, as between its input terminal 32 and output terminal 33. This is achieved by proportioning the transconductance of transistor 36 to that of transistor 35 in $H_O$-to-one ratio at low current levels. Assuming transistors 35 and 36 to have similar diffusion or implantation profiles this is done by making the effective area of the base-emitter junction of transistor 36 $H_O$ times the effective area of the base-emitter junction of transistor 35.

The current gain of current amplifier 20 is $-G$, where G is a positive number. The product of $H_OG$, the low-current-level open loop gain of the regenerative feedback loop connection of amplifiers 20 and 30, is chosen to exceed unity. Accordingly, a small initial disturbance in the loop (as may be administered by any of several known starting circuits, if necessary) will initiate a steady build up of currents in amplifiers 20 and 30. With this build up in current levels, the current gain of current amplifier 30 decreases from $-H_O$ until it reaches a value of $-1/G$, at which current levels the unity closed-loop gain condition obtains and the loop remains in equilibrium.

Under these equilibrium conditions, $\Delta V_{BE}$, the difference between the base-emitter potentials $V_{35}$ and $V_{36}$ of transistors 35 and 36, respectively, appearing as a potential drop across resistive element 34, can be determined proceeding from the following basic equation describing transistor action.

$$V_{BE} = (kT/g)\ln I_E/AJ_S) \quad (1)$$

where $V_{BE}$ is the base-emitter potential of the transistor, $k$ is Boltzmann's constant, $T$ is absolute temperature of the transistor base-emitter junction, $q$ is the charge on an electron, $I_E$ is the emitter current of the transistor, $A$ is the area of the transistor base-emitter junction, and $J_S$ is the emitter current density during saturation of the transistor.

Numerical subscripts for these quantities relate them to the transistor having that identification numeral. $J_S$ is assumed the same for integrated transistors 35 and 36 since they are fabricated by the same process steps, and their junction temperatures are caused to be substantially equal by locating them close by each other on the integrated circuit.

$$\Delta V_{BE} = V_{BE35} - V_{BE36} \quad (2)$$

Substituting from equation 1 into equation 2, equation 3 is obtained.

$$\Delta V_{BE} = (kT/q)\ln(I_{E35}/J_S) - (kT/q)\ln(I_{E36}/H_OJ_S) = (kT/q)\ln(H_OI_{E35}/I_{E36})) \quad (3)$$

Equation 4 describes the equilibrium loop condition and substituted into equation 3 yields equation 5.

$$I_{E35}/I_{E36} = G \quad (4)$$

$$\Delta V_{BE} = (kT/q)ln\ G\ H_O \quad (5)$$

The current flow $I_1$ through resistive element 34 with resistance $R_{34}$ is determined in accordance with Ohm's Law.

$$I_1 = \Delta V_{BE}/R_{34} = (kT/q\ R_{34})\ln G\ H_O \quad (6)$$

$I_1$ is substantially equal to the collector current of transistor 35, assuming the base current of transistor 36 to be negligibly small, which assumption closely approximates actuality if the common-emitter forward current gain, or $h_{fe}$, of transistor 36 is of reasonably large value (e.g., more than 30). The collector current of a transistor is $-\alpha$ times its emitter current, $\alpha$ being a factor well-defined to within a percent or so and nearly equal to unity in a transistor with reasonably large $h_{fe}$.

$$I_{E35} = I_1/\alpha_{35} = (kT/q\ \alpha_{35}\ R_{34})\ln G\ H_O \quad (7)$$

The equilibrium value of $I_{E36}$ is obtained by combining equations 4 and 7 per equation 8.

$$I_{E36} = (I_{E35}/G) = (kT/q)\ \alpha_{35}\ G\ R_{34})\ln G\ H_0 \quad (8)$$

The current $I_2$ flowing through resistive element 44 is substantially equal to $I_{E35}$. So, one can, by application of Ohm's and Kirchoff's Laws, derive the potential drop across resistive element 44, which drop is the resistance $R_{44}$ of element 44 times $I_2$, in terms of the $\Delta V_{BE}$ potential drop across resistive element 34, which drop is the resistance $R_{34}$ of element 34 times $I_1$. The positive-temperature-coefficient potential $V_+$, which is the sum of the potential drops across resistive elements 34 and 44, will have substantially the following value.

$$V_+ = \Delta V_{BE}[1 + (R_{44}/\alpha_{35} R_{34})] \quad (9)$$

Combining equations 6 and 9 one obtains the following.

$$V_+ = (kT/q)\,[1 + (R_{44}/\alpha_{35}R_{34})]\ln G\,H_0 \quad (10)$$

As has been indicated in previous portions of the specification, $\alpha_{35}$ and $H_0$ are both well-defined and $k$ and $q$ are universal constants. $R_{34}$ and $R_{44}$, if resistive elements 34 and 44 are concurrently formed in a monolithic integrated circuit by identical process steps, are in constant ratio to each other. If current amplifier 20 is a current mirror amplifier, for example, G is substantially constant, despite changes in temperature and current levels. Accordingly, $V_+$ is very well defined in terms of temperature.

The potential appearing between terminals 12 and 23 is the sum of $V_{BE36}$ and $V_+$. Applied to the input of a zero-offset potential follower 50, this potential causes a potential $V_{OUT}$ at the output terminal 55 of follower 50 which will have substantially the following value.

$$V_{OUT} = V_{BE36} + V_+ = V_{BE36} + (kT/q)\,[1 + R_{44}/\alpha_{35}R_{34})]\ln G\,H_0 \quad (11)$$

$V_{OUT}$ can then be applied to a load such as resistive load 56, the buffering action of potential follower 50 preventing such loading from affecting the current regulating actions in the positive feedback loop connection of current amplifiers 20 and 30. Knowing the value of $I_{E36}$ the current regulator 10 will maintain and its temperature coefficient as affected by $R_{34}$, one can determine by measurement on transistors of the type to be used for transistor 36 the value of $V_{BE36}$ versus temperature. $V_{BE36}$ will, as wellknown, display a negative-temperature-coefficient owing to the temperature-dependency of $J_S$ predominating in equation 1. By choosing $V_+$ of such magnitude its positive-temperature-coefficient equals the negative-temperature-coefficient of $V_{BE36}$, $V_{OUT}$ will be temperature-independent. It can be shown that under these circumstances, $V_{OUT}$ will be equal to the extrapolated bandgap potential of the semiconductor material from which transistors 35 and 36 are made. While potential follower 50 is shown as comprising an operational amplifier with its output terminal directly connected to its inverting terminal and with its non-inverting input terminal having the potential at terminal 23 thereto applied, potential follower 50 may take other known forms. Also, one may modify the structure as used as a potential follower 50 in FIG. 1, inserting a potential divider between the output terminal and inverting input terminal of the operational amplifier. This will increase $V_{OUT}$ from the value given in equation 11 by a factor equal to the potential division ratio of the potential divider.

FIG. 2 shows a reference potential generator that is a modification and functional equivalent of the FIG. 1 reference potential generator. In FIG. 2, the current $I_3$ flowing through resistive element 54 having a resistance $R_{54}$ causes a potential drop equal to $I_3 R_{54}$. $I_3$ equals the sum of $I_{E35}$ and $I_{E36}$, so the drop across resistive element 54 is $(I_{E35} + I_{E36})\,R_{54}$. In FIG. 2, as in FIG. 1, the positive feedback loop connection of current amplifiers 20 and 30 stabilizes with $I_{E35}$ being in G:1 ratio with $I_{E36}$, so the drop across resistive element 54 is $[1 + (1/G)]\,I_{E35}R_{54}$. Referring back to FIG. 1, the drop across resistive element 44 is $I_2 R_{44}$. $I_2$ is substantially equal to $I_{E35}$ so the drop across resistive element 44 is substantially $I_{35}\,R_{44}$. If the FIG. 1 and 2 circuits are to provide like potentials between their respective terminals 12 and 23, the potential drop across resistive element 54 must equal the potential drop across resistive element 44.

$$I_{E35}\,R_{44} = [1 + (1/G)]\,I_{E35}\,R_{54} \quad (12)$$

Therefore, $R_{54}$ should have the following value.

$$R_{54} = G\,R_{44}/(G+1) \quad (13)$$

One familiar with circuit design will perceive that further modifications that are functional equivalents of the FIG. 1 circuit exist, in which resistive elements appear both between terminals 23 and 32 and between terminals 31 and 12.

FIG. 3 shows a specific current amplifier 20' as may be used for current amplifier 20 in either of the reference potential generators shown in FIGS. 1 and 2. Current amplifier 20' comprises transistors 24 and 25 having respective base-emitter junctions with respective effective areas in 1 to $G_0$ ratio. If the resistances of resistors 27 and 28 are in $G_0$:1 ratio, current amplifier 20' is a current mirror amplifier with a current gain of $-G_0$. Transistor 24 is provided with direct coupled collector-to-base feedback to adjust its base-emitter potential to condition it to supply a collector current equal to the current demand presented to input terminal 22' of the current mirror amplifier. This direct-coupled collector-to-base feedback might be a direct connection, but often includes a current amplifier such as the common-collector amplifier transistor 26 to reduce the effects of the base currents of transistors 24 and 25 in the current gain of amplifier 20'. By proportioning the resistances of resistors 27 and 28 inversely as the transconductances of transistors 24 and 25, respectively, application of the same base potential to transistor 25 as to transistor 24 conditions it for supplying a collector current $G_0$ times as large as that of transistor 25. Alternatively, resistors 27 and 28 may be replaced by direct connections of the emitter electrodes of transistors 24 and 25 to common terminal 21, and current amplifier 20' would still function as a current mirror amplifier.

Current amplifier 20 need not be a current mirror amplifier, however, nor need it be an amplifier with gain that is invariant with input current level either. It is desirable that the current gain of current amplifier 20 be independent of the $h_{fe}$'s of its transistors so that current levels in the current regulating circuit 10 are predictable and have one less temperature-dependent factor determining them. The regulation exhibited by circuit 10 is improved as the amplitude G of the gain of current amplifier 20 is made larger, but achieving large values of G using current mirror amplifiers or other fixed current gain amplifier techniques takes up extensive area on the integrated circuit die. When current amplifier 20 is constructed with bipolar junction transistors rather than field effect transistors, it is advantageous to modify current amplifier 20' so as to increase the ratio of the resistance of resistor 27 to that of resistor 28 to values larger than $G_0$ in current amplifier 20', which increases the current gain of transistor 20 above $G_0$ as current levels rise. This permits a circuit having smaller values of $G_0$ and $H_0$ (which can usually be realized in a smaller die area), but exhibiting the large $G\ H_0$ product in the range of current levels where equilibrium is achieved in the positive feedback loop which is required to get good current regulation.

The current amplifier 20" of FIG. 4 results when this modification procedure is carried out fully. A variety of current mirror amplifiers besides those having the structural connections of current amplifier 20' can be used as current amplifier 20 and also these current mirror amplifiers, as modified similarly to the modifications of the current mirror amplifier described above. The important thing to understand about these modified current mirror amplifier structures is that their current gains are still substantially independent of the $h_{fe}$'s of the transistors and do not change with temperature. In the structures of FIGS. 3 and 4 to which all of these structures are analogous, this comes about because the small difference between the emitter potentials of transistors 24 and 25 is proportional to $\Delta V_{BE}$. Any potential drop across a resistive element 27 is proportional to the $\Delta V_{BE}$ drop across resistive element 34 because substantially the same current flows through them. Since the proportionality between collector currents of transistors 35 and 36 does not change with temperature, the potential drop across resistive element 27 responsive to the collector current of transistor 36 flowing therethrough is proportional to the $\Delta V_{BE}$ drop. In current amplifier 20" of FIG. 4, the potential drop across resistive element 27 proportional to $\Delta V_{BE}$ is the potential difference linearly proportional to T known to be required between the emitter-to-base potentials of transistors 24 and 25 to maintain their collector currents in constant ratio. In current amplifier 20' of FIG. 3 since each of the potential drops across resistive elements 27 and 28, respectively, are proportional to $\Delta V_{BE}$, so is their difference. This difference is equal to the difference between the emitter-to-base potentials of transistors 24 and 25, which must then be in the linear proportion to T known to cause the collector currents of transistors 24 and 25 to be in temperature-independent ratio.

The positive feedback loop including amplifier 30 and the other current amplifier 20, 20' or 20", exhibits a tendency towards assuming a stable state in which no currents flow in the loop at the time potential is first applied between terminals 11 and 12. The loop can be forced out of this undesirable condition by applying a small starting current to the input terminal of either of these current amplifiers, a variety of apparatus suitable to this purpose being known. Or one may arrange for a relatively minute leakage current to be constantly applied to the input terminal of one of the current amplifiers—e.g., an open-base transistor may have its collector-to-emitter path connected between terminals 11 and 32.

What is claimed is:

1. A reference potential generator comprising:

first and second transistors of the same conductivity type, each having base and emitter electrodes with a base-emitter junction therebetween and having a collector electrode;

an interconnection of the emitter electrodes of said first and said second transistors without substantial intervening impedance, whereby the emitter potentials of said first and said second transistors are equal;

positive feedback loop means responsive to the collector current of said first transistor for applying forward biasing base potentials to the base electrodes of said first and said second transistors to control the densities of current flow through the base-emitter junctions of said first and said second transistors, respectively, said positive feedback loop means including means responsive to the collector current of said first transistor for maintaining a difference between the base potentials of said first and said second transistors, whereby the densities of current flow through the base-emitter junctions of said first and said second transistors are forced to differ from each other; and means responsive to said difference between the base potentials of said first and said second transistors for developing a positive-temperature-coefficient component of said reference potential.

2. A reference potential generator as set forth in claim 1 wherein said means for maintaining a difference between the base potentials of said first and said second transistors includes a resistance connected between the base electrodes of said first and said second transistors and means for causing a current related to the collector current of said first transistor to flow through said resistance.

3. A reference potential generator, in combination with means for utilizing the reference potential it supplies, said reference potential generator including:

a first current amplifier having input and output and common terminals, having first and second transistors of the same conductivity type with respective base and emitter and collector electrodes, and having a first resistive element connected between the base and collector electrodes of said first transistor, the base electrodes of said first and said second transistors being connected respectively to the input terminal of said first current amplifier and to the collector electrode of said first transistor, the emitter electrodes of said first and said second transistors being connected to the common terminal of said first current amplifier, the collector electrode of said second transistor being connected to the output terminal of said current amplifier, and said first and said second transistors being operated at the same absolute temperature T;

means connecting said first current amplifier in a positive feedback loop for causing respective offset potentials between the base and emitter electrodes of each of said first and said second transistors and thereby establishing a positive-temperature-coefficient potential proportional to T across said first resistive element, including a second current amplifier having input and output terminals between which a current gain of $-G$ is exhibited, G being a positive number, including means for applying current flow from the output terminal of said first current amplifier to the input terminal of said second current amplifier, and including means for applying current flow from the output terminal of said second current amplifier to the input terminal of said second current amplifier to the input terminal of said first current amplifier; and means proportionally responsive to the positive-temperature-coefficient potential across said first resistive element for deriving at least one further positive-temperature-coefficient potential, the emitter-to-base potential of at least the first of said first and said second transistors being augmented by at least one of said positive-temperature-coefficient potentials in determining said reference potential.

4. A reference potential generator as set forth in claim 3 wherein said means for deriving at least one further positive-temperature-coefficient potential includes a second resistive element also included in said means for applying current flow from the output terminal of said second current amplifier to the input terminal of said first current amplifier, a said further positive-temperature-coefficient potential being developed as the potential drop across said second resistive element.

5. A reference potential generator as set forth in claim 3 wherein said means for deriving at least one further positive-temperature-coefficient potential includes a second resistive element connected to conduct current flowing through the common terminal of said first current amplifier, whereby a said further positive-temperature-coefficient potential appears as a potential drop across said second resistive element responsive to this current flow therethrough.

6. A reference potential generator in combination with means for utilizing the reference potential it supplies, said reference potential generator comprising:

first and second terminals connected to said means for utilizing the reference potential and a third terminal between which first and third terminals energizing potential is applied;

first and second transistors of a first conductivity type operated at the same absolute temperature T as each other, each of said first and said second transistors having respective base and emitter and collector electrodes;

a direct interconnection without substantial intervening impedance between the emitter electrodes of said first and said second transistors; and a first direct current conductive path between that direct interconnection and said first terminal;

a first resistance having a first end to which the base electrode of said first transistor is connected and having a second end to which the base electrode of said second transistor and the collector electrode of said first transistor are each connected;

a second direct current conductive path between the first end of said first resistance and said first terminal;

further resistance included in at least one of said first and said second direct current conductive paths;

third and fourth transistors of a second conductivity type complementary to said first conductivity type, each of said third and said fourth transistors having first and second and control electrodes and having a principal conduction path between its first and second electrodes the conduction of which is controllable in response to potential applied between its first and control electrodes;

means for adjusting the conduction of the principal conduction path of said third transistor, including a third direct current conductive path between the first electrode of said third transistor and said second terminal, including a fourth direct current conductive path between the collector electrode of said second transistor and the second electrode of said third transistor, and including direct coupling of the collector electrode of said second transistor to the control electrode of said third transistor; and means for conditioning said fourth transistor for conduction through its principal conduction path which is proportional to the conduction of said third transistor through its principal conduction path, including means for applying a potential to the control electrode of said fourth transistor equal to that at the control electrode of said third transistor, including a fifth direct current conductive path between the first electrode of said fourth transistor and said second terminal, and including a sixth direct current conductive path between the second electrode of said fourth transistor and said third terminal, said reference potential being developed between said first and said second terminals responsive to application of an energizing potential between said first and said third terminals.

7. A reference potential generator as set forth in claim 6 wherein said third and said fifth direct current conductive paths pass through a common point, to which common point the first electrodes of said third and said fourth transistors are directly connected without substantial intervening impedances.

8. A reference potential generator as set forth in claim 6 wherein:

said third and said fifth direct current conductive paths pass through a common point;

a third resistance is included in said third direct current conductive path, between the first electrode of said third transistor and said common point;

and a fourth resistance proportional to said third resistance is included in said fifth direct current conductive path, between the first electrode of said fourth transistor and said common point.

9. A reference potential generator as set forth in claim 6 wherein:

said third and said fifth direct current conductive paths pass through a common point;

a third resistance is included in said third direct current conductive path, between the first electrode of said third transistor; and the first electrode of said fourth transistor is connected directly to said common point.

* * * * *